US006071028A

United States Patent [19]

Klawson

[11] Patent Number: 6,071,028

[45] Date of Patent: Jun. 6, 2000

[54] HIGH PRODUCT RETENTION ELEVATOR CUP

[75] Inventor: Rennold Lodge Klawson, Flemington, N.J.

[73] Assignee: Carter-Wallace, Inc., New York, N.Y.

[21] Appl. No.: 09/277,221

[22] Filed: Mar. 27, 1999

[51] Int. Cl.[7] ..... A45D 40/04

[52] U.S. Cl. ..... 401/75; 401/87; 401/175

[58] Field of Search ..... 401/68, 75, 86, 401/87, 174, 175

[56] References Cited

U.S. PATENT DOCUMENTS

| | | | |
|---|---|---|---|
| 4,369,158 | 1/1983 | Woodruff et al. | 264/268 |
| 4,518,553 | 5/1985 | Yarossi et al. | 264/234 |
| 4,552,161 | 11/1985 | Hill et al. | 132/885 |
| 4,605,330 | 8/1986 | Crowley et al. | 401/68 |
| 4,702,399 | 10/1987 | Davis | 222/390 |
| 4,915,528 | 4/1990 | Seager | 401/68 |
| 4,950,094 | 8/1990 | Yorks | 401/75 |
| 5,000,356 | 3/1991 | Johnson et al. | 222/391 |
| 5,181,790 | 1/1993 | Lucas | 401/75 |
| 5,275,496 | 1/1994 | Fattori et al. | 401/68 |
| 5,390,894 | 2/1995 | Meehan | 249/96 |
| 5,401,112 | 3/1995 | Dornbusch et al. | 401/68 |
| 5,518,715 | 5/1996 | Rosenblatt | 424/65 |
| 5,547,302 | 8/1996 | Dornbusch et al. | 401/172 |
| 5,573,341 | 11/1996 | Iaia | 401/172 |

*Primary Examiner*—Steven O. Douglas
*Assistant Examiner*—Peter deVore
*Attorney, Agent, or Firm*—Kenneth Watov; Watov & Kipnes, P.C.

[57] ABSTRACT

An elevator cup configured for vertical sliding movement and for retaining a portion of a solid stick-form product within a dispensing container. The dispensing container has an internal surface, an open top end, a closed bottom end, and means for selectively reciprocally moving the elevator cup in a piston-like manner between a retracted position adjacent the closed bottom end and a fully advanced position adjacent the open top end. The elevator cup includes a horizontal base with top and bottom portions. The top portion is configured for retaining an end portion of the stick-form product. A ductile flange extends along a perimeter of the base for sealing against the internal surface of the container to prevent seepage of liquid product and product volatiles, and to substantially absorb and distribute shock associated with handling of the container, away from the product.

17 Claims, 14 Drawing Sheets

HIGH PRODUCT RETENTION ELEVATOR CUP

RELATED APPLICATION

The present invention is related to that of co-pending design Application Serial No. (Attorney Docket No. 924.1.045A, which was filed herewith.)

FIELD OF THE INVENTION

The present invention relates generally to solid stick-form product packages. More particularly, the invention relates to movable product retaining elevator cups residing within such packages for dispensing product.

BACKGROUND OF THE INVENTION

Containers having mechanisms for advancing or retracting product from an open end are typically used to house and dispense solid materials such as deodorant or antiperspirant sticks. Such devices generally include a container with a product outlet, a cover over the outlet, an elevator cup to advance or retract the material being dispensed toward or away from the outlet, respectively, and means to move the elevator cup to effect such advancement or retraction.

Often, such dispensers are top-filled by pouring molten deodorant material into the product outlet with the elevator cup fully retracted from the outlet, for example. The deodorant material is then allowed to cool and solidify into a stick shaped like the interior of the container. As the material cools, the product becomes securely attached to the contact surface of the cup by natural adhesion.

In the design and manufacture of a deodorant or antiperspirant product dispenser, it is preferable that the product be securely retained within the container and prevented from falling out during consumer use. It is also preferred that users are able to retract the product back into the container, and recap the container after use to prevent premature drying of the product. To ensure that retractability is preserved, the product must be firmly anchored to the cup at all times. Both of these preferences are a function of the cup's capacity to withstand the loosening effects of shocks associated with shipping and regular usage.

To combat the problem of product-cup separation, known prior cups typically employ large retaining reservoirs and other configurations incorporating such elements as fins, cleats and the like, for better product-to-cup adherence. These designs usually result in using more material for the cup assembly, and/or using a larger amount of extra product for securing the product to the cup. The extra product or hang-up is the unreachable portion of the product that resides within the retaining part of the cup. The results of the design compromises are increased manufacturing and shipping costs, and loss profits due to waste of product.

For the foregoing reasons, there is a need for an improved elevator cup with high reliability for retaining product thereon, while being simple to manufacture, using a minimal amount of fabricating material for the elevator cup, and minimizing product hang-up.

SUMMARY OF THE INVENTION

The present invention is generally directed to an elevator cup for use in a stick-form product container or dispenser. The product container is a tubular body including an internal surface, an open top end, a closed bottom end, and a means for selectively reciprocally move the elevator cup in a piston-like manner between a retracted position adjacent the closed bottom end and a fully advanced position adjacent the open top end. The elevator cup includes a horizontally oriented base with top and bottom portions. The top portion of the base is configured for retaining a portion of a stick-form product. A ductile flange extending along the perimeter of the base, seals against the opposing internal surface of the container to prevent seepage of liquid product and product volatiles, and to substantially absorb and distribute shock associated with handling of the container, away from the product-cup interface.

More specifically, the elevator cup further includes an elongated closed and continuous inner partition having an outside sidewall, and an inside sidewall, disposed on the top portion of the elevator cup for forming two opposing peripheral basins between the outside sidewall of the inner partition and the flange, and a central basin bounded by the inside side wall of the inner partition. The inner partition via its inside, outside, and top surfaces along with the inside surface of the peripheral wall, and the exposed base portions, provide the multiple contact areas with the product for improved adhesive strength, thereby minimizing the loosening of the product from the elevator cup, relative to elevator cups of the prior art.

In one embodiment of the present invention, the elevator cup further includes a continuous hollow threaded center post projects vertically through the center of the base. The moving means of the container comprises a spindle and a dial wheel in engagement with the center post. The closed bottom end includes a center aperture therein. The spindle includes a threaded shaft oriented axially within the container and rotatably mounted at the closed bottom end through the center aperture. The threaded center post is engaged with the threaded shaft of the spindle. A means for sealing the center post against the spindle is provided to prevent seepage of product during top filling when the elevator cup is in the lowermost position in the container.

In an alternative embodiment of the present invention, the elevator cup further includes an imperforate base and an internally threaded sleeve extending from the bottom portion of the elevator cup. The moving means of the container comprises a threaded column and a dial wheel in engagement with the sleeve. The closed bottom end includes a center aperture therein with the dial wheel rotatably mounted at the closed bottom end, and having the externally threaded column extending axially therefrom through the center aperture into the container and in threaded engagement with an internally threaded cylindrical sleeve extending from the bottom portion of the base without extending through the base, so that rotation of the dial wheel relative to the container and elevator cup telescopically provides reciprocally axial movement of the elevator cup.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention is generally directed to an elevator cup providing improved retention of a stick-form product while utilizing less fabricating material for the elevator cup itself and requiring less hang-up of product for anchorage, relative to the prior art.

Figure 1:
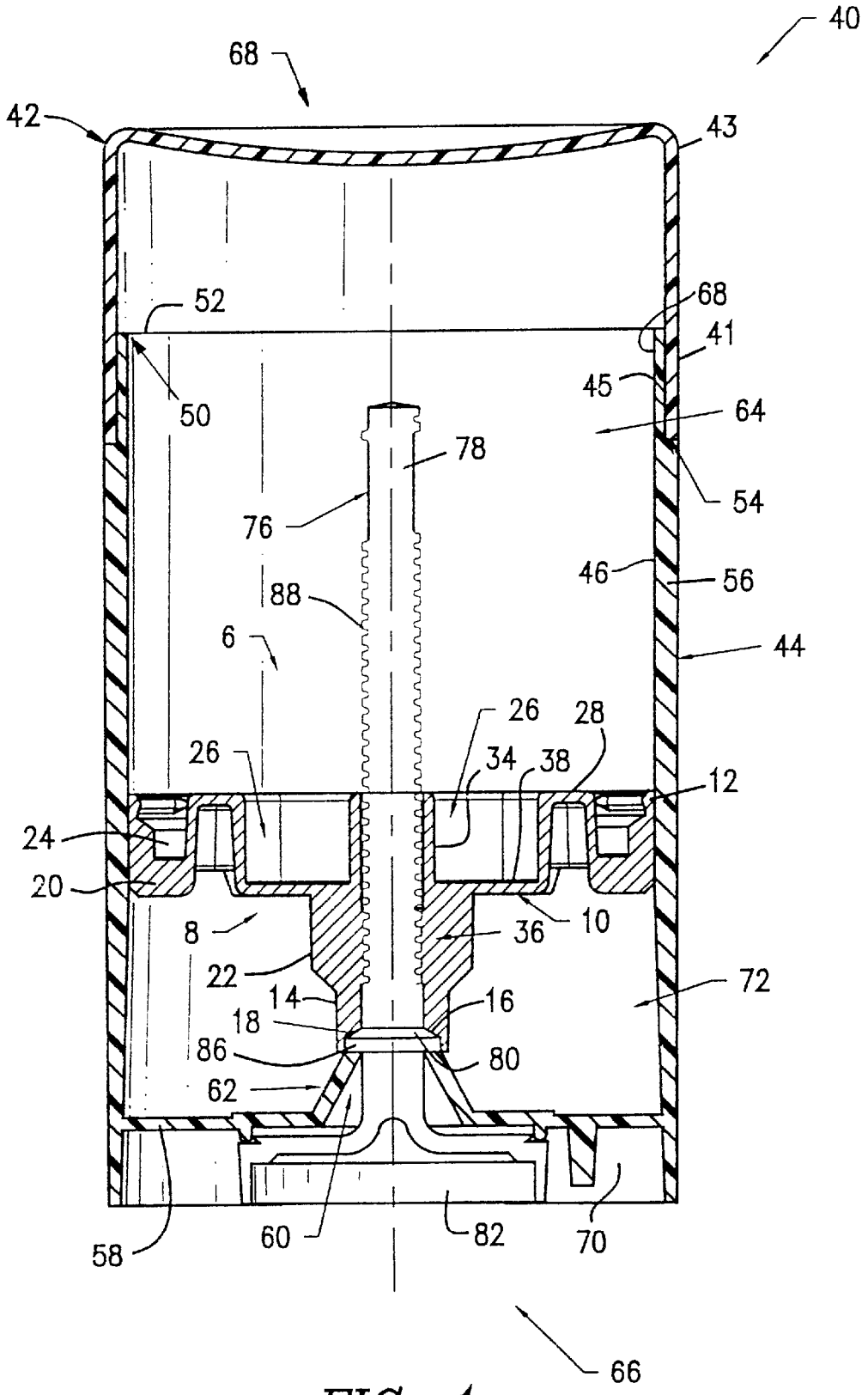
FIG. 1 is a cross sectional elevational view showing a screw-type stick-form product container with an elevator cup of one embodiment of the invention disposed therein.

Referring now to the drawings, there is shown in FIG. 1, a representative package 40 for dispensing a product in stick-form such as a deodorant or antiperspirant. Typically, the package 40 comprises a barrel 44 having elongated tubular side walls 56. In one embodiment, the side walls will have an oval or circular cross section. A base wall 58 of barrel 44 has a central aperture 60 provided therein. The upper end 68 of barrel 44 is open. The barrel 44 is typically made of a rigid plastic such as polypropylene. An moving means is provided at a lower end 66 of the barrel 44 to permit the user to reciprocally move the product axially between a retracted position adjacent the closed bottom end and a fully advanced position adjacent the open top end.

Disposed within the barrel 44 is a spindle 76 having a threaded shaft member 78 and dial or thumb wheel 82. The shaft member 78 axially extends from the aperture 60 within the barrel 44, whereas the dial wheel 82 is external of the barrel 44 and partially disposed within a stepped recessed area 70 formed between the side walls 56 at the lower end 66. As can best be seen in FIG. 2, the spindle 76 is provided with a retaining collar 86 that is in snap fit engagement with tapered tabs 62 of the base wall 58. As shown in FIG. 1, this secures engagement of the spindle 76 within the barrel 44 while permitting rotational movement. Spindle 76 is typically made of plastic such as polypropylene. During assembly, the upper portion of spindle 76 is pushed through aperture 60, the retaining collar 86 is snapped through tabs 62, thereby captively retaining a bottom portion of collar 86 against a top edge of tabs 62, and an upper top portion of dial wheel 82 against a bottom portion of base wall 58, as shown.

Referring back to FIG. 1, an elevator cup of the invention is designated generally by the reference character 10, and is shown disposed within the barrel 44. The elevator cup 10 or cup hereinafter, provides a platform for vertical sliding movement and securement of the stick-form product within the package 40.

Figure 3:
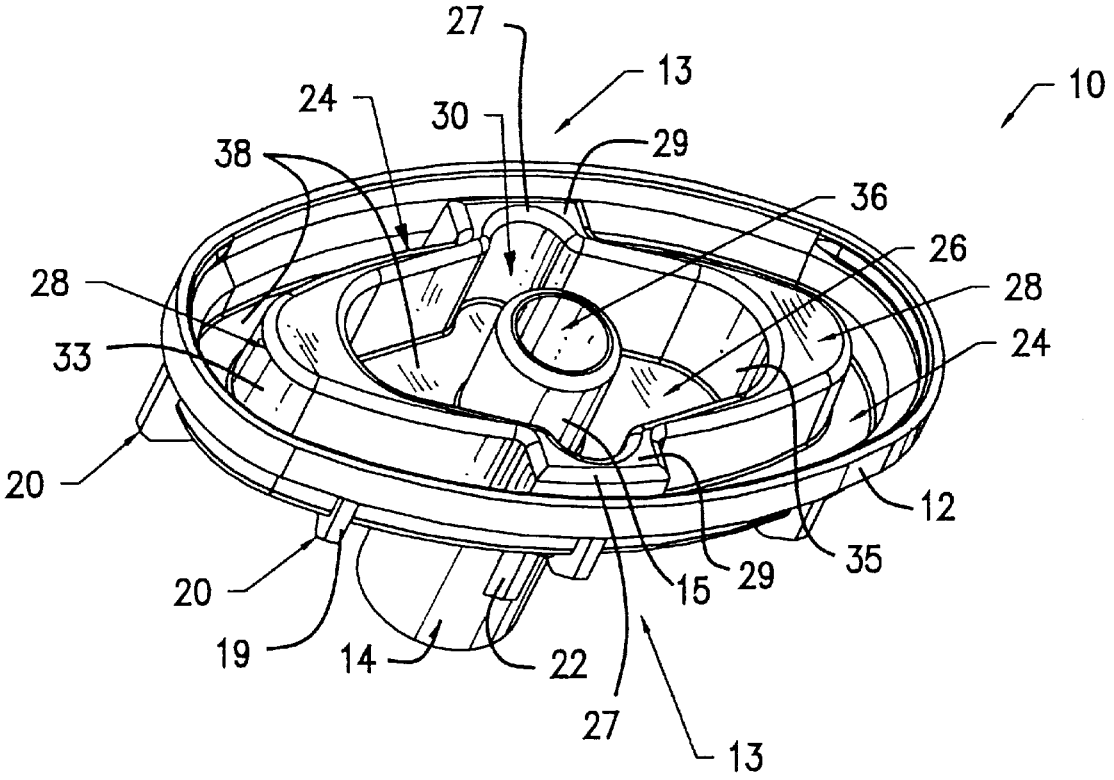
FIG. 3 is a top perspective view of an embodiment of the elevator cup of FIG. 1.
Figure 4:
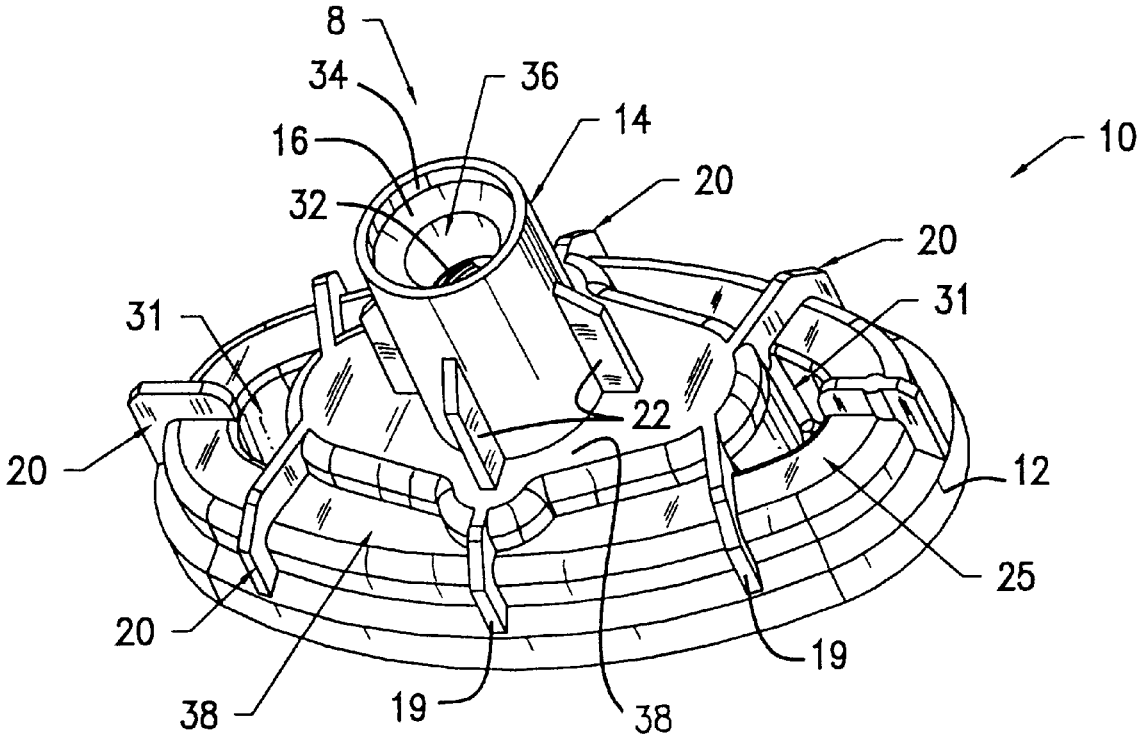
FIG. 4 is a bottom perspective view of the elevator cup.

As best shown in FIGS. 3 and 4, the cup 10 is of a unitary construction, and includes top 6 and bottom 8 portions. The cup 10 may easily be fabricated using molded or extruded plastic polymer processes. It should be also recognized that various other forms including different shapes and sizes of cups to conform with the different forms and shapes of the barrel, may be utilized within the spirit and the scope of the invention.

FIG. 1 illustrates the cup 10 in the lowermost position within the barrel 44. A threaded central hub 36 within a center post 14 of the cup 10 is engaged with the threaded shaft 78 of the spindle 76. By rotating the dial wheel 82 of the spindle 76 in the clockwise or counterclockwise direction, the cup 10 moves or travels up or down depending on the orientation of threads along the threaded shaft 78 within the barrel 44. As the cup 10 travels up or down the shaft 78, the product is advanced or retracted, respectively, through the outlet 50.

The periphery of the cup 10 is sealed against the contiguous sections of an internal surface 46 of barrel 44 by a ductile flange or collar 12 extending along the cup's outer perimeter. The flange 12 prevents product and its associated volatiles from escaping around the cup 10 to the bottom lower end 66 and void cavity or space 72 of the package 40 during top filling, shipment, and storage. The flange 12, being thin enough to be flexible, serves to absorb shocks associated with shipping and use, away from the product, thereby minimizing the likelihood of the product breaking loose from the cup 10. The cup 10 is preferably made of a flexible material such as polyethylene in order to provide a good fluid seal and excellent shock absorption.

Figure 2:
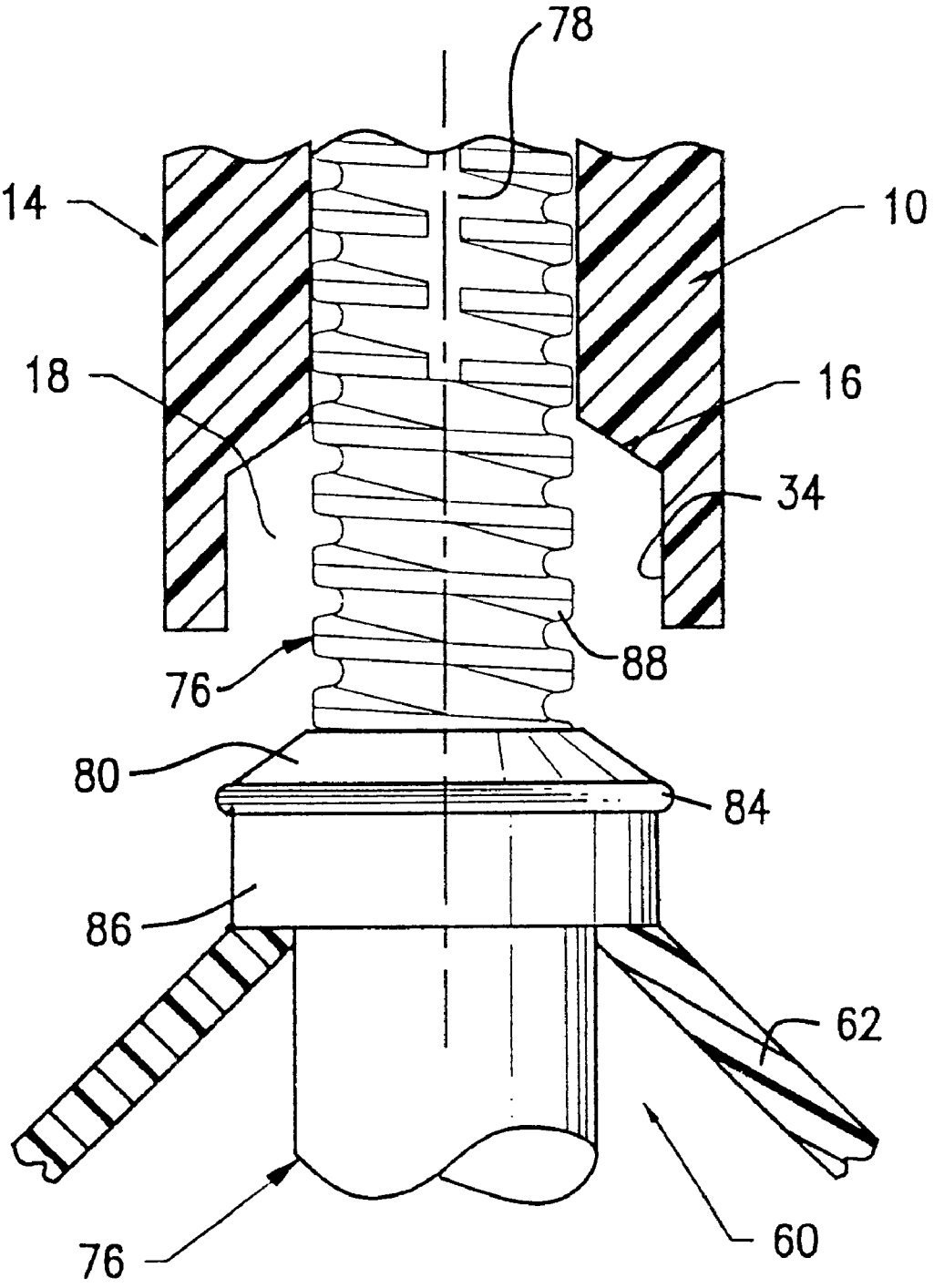
FIG. 2 is an enlarged cross sectional view of a center post/threaded shaft interface of the container shown in FIG. 1.

By referring to FIG. 2, one can best see how the interface between the center post 14 of the cup 10 and the threaded shaft 78 of the spindle 76 are sealed when the cup 10 is in its lowermost position, as shown in FIG. 1. Spindle 76 is provided with a tapered annular ring 80 directly below the bottom of the threaded shaft 78. The center post 14 of cup 10 includes bore 18 including an upper annular chamfer 16. When the cup 10 is in its lowermost position, the edge portion of the chamfer 16 compresses against the surface of the tapered ring 80 forming a fluid seal 18 therebetween.

Spindle 76 further includes an annular rib 84 which exerts a compression force against an interior wall 34 of center post 14. Annular rib 84 can act both as a secondary seal for the post/threaded shaft interface and as a brake to prevent the cup 10 from creeping up during handling, manufacturing, shipping and storage operations. Movement of the cup 10 prior to use by the consumer is undesirable since it would jeopardize the effectiveness of the seal between chambers 16 and 80, result in leakage or premature drying of the product. Rib 84 can be intermittent if it is to serve only as a brake or continuous to serve both as a brake and as an added seal.

Figure 5:
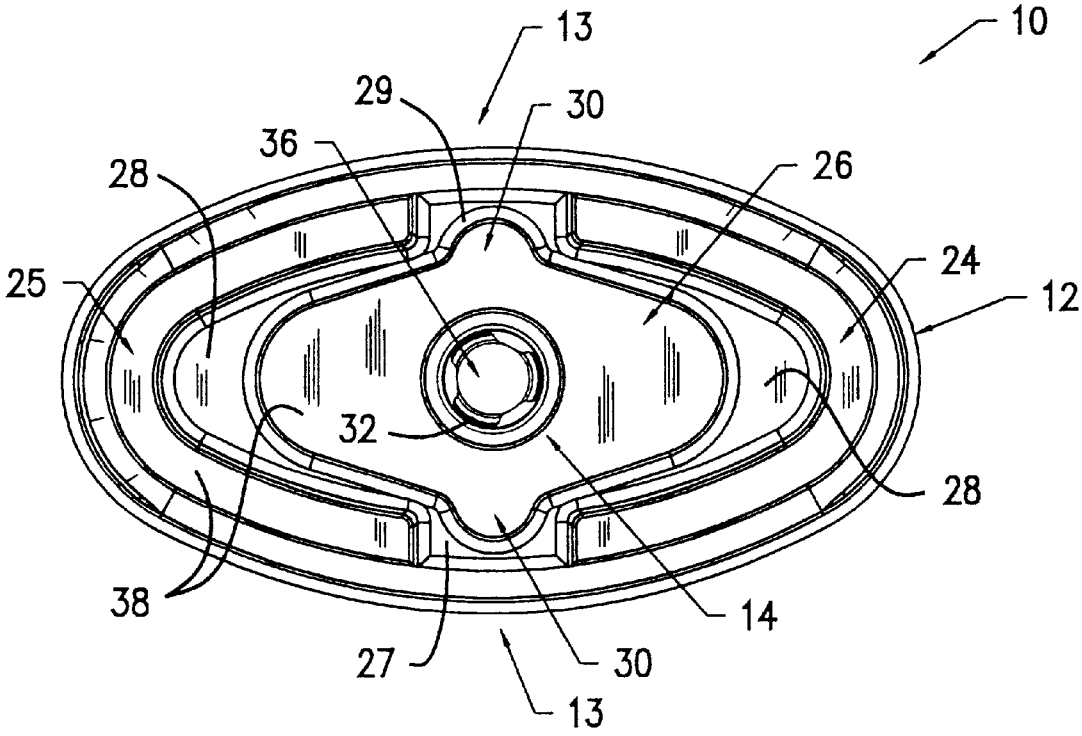
FIG. 5 is a top plan view of the elevator cup.
Figure 6:
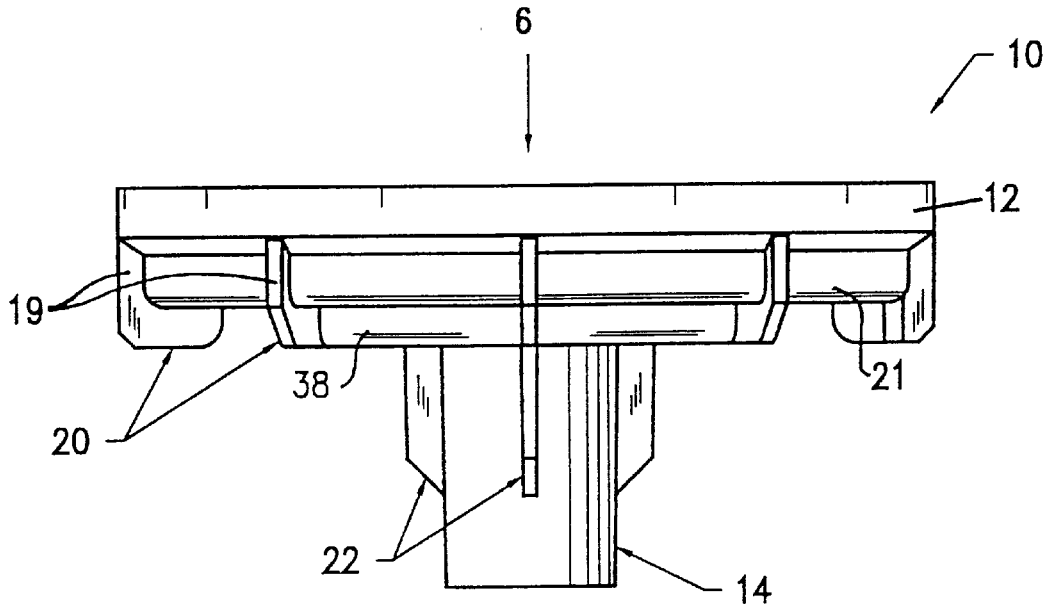
FIG. 6 is a front elevational view of the elevator cup.

Referring specifically to FIGS. 3 and 5, the top portion 6 of the cup 10 includes in each half portion an outer or peripheral retention basin 24. Each peripheral basin 24 is located between a common outer circumferential wall serving as a sealing flange 12, and an associated one of two inner partitions 28 (one in each half portions). Each of the inner partitions, have an outside sidewall 33 and an inside sidewall 35. The top portion 6 further includes a centrally located inner or central retention basin 26 surrounding an upper portion 15 of the center post 14 which is centrally located therein, with basin 26 being common with and extending between each half portion. As shown, basin 26 is also symmetrical about each half portion of the top 6 of cup 10.

The inner partition 28 in each half portion provides an increase in the contact surface area of the cup 10 for better product-cup adhesion. The contact surfaces of each inner partition 28 portion include the top surfaces, and the sidewall surfaces 33 and 35. In addition, each partition 28 serves as a secondary barrier to any shock not dissipated by the flange 12. This feature further minimizes the loosening effects to the product/cup adhesion.

In one embodiment of the cup 10, the central basin 26 includes a pair of opposing semicircular retention channels 30 formed from outwardly protruding U-shaped protrusions 29 of the partition 28, as shown in FIGS. 3 and 5. The channels 30 improve the anchoring of the product in the central basin 26. The exterior part 27 of each U-shaped protrusion 29 of the partition 28, is integral with an arcuate portion of the flange 12, and provides some support against excessive flexing when significant shock is encountered.

Referring to FIGS. 4, 6, 7, and 9, the center post 14 with the threaded central hub 36 therein, vertically projects through the center of the base 38. The bottom portion 8 includes a plurality of post gusset plates 22 arranged in a spaced apart manner radially around the center post 14 and buttressed against the base 38. The gusset plates 22 provide for a more rigid center post 14 to withstand the stresses of automated high speed assembly while saving weight. The gusset plates 22 also preserve the horizontal orientation of the base 38 of the cup 10 within the barrel 44. This feature is essential for ensuring a proper seal along the flange 12 and for keeping intact the adhesive contact between the product and cup 10.

The bottom portion 8 further includes a plurality of stabilizing ribs 20 disposed radially in a spaced apart manner along a bottom circumferential portion 21 of the base 38. The ribs 20 serve to bias the ductile flange 12 against the interior surface 46 of the barrel 44. This will increase the effectiveness of the peripheral seal by compensating for molding tolerances and the ductileness of the flange 12.

The plurality of stabilizing ribs 20 also serve to absorb and distribute, like the flange 12, any shock to the package 40 away from the product. The vertical edges 19 of each rib 20 are positioned flush against the interior surface of 46 of the barrel 44. When a shock is applied to the barrel 44, and therefrom to the flange 12, the edges 19 absorb and distribute the shock toward the middle of the base 38 along the bottom portion 8, minimizing the likelihood of product-cup separation. In a manner similar to the gusset plates 22, the ribs 20 assist in maintaining the horizontal orientation of the base 38 by increasing the rigidity of the base 38 without incurring notable weight increases. This prevents the base 38 from skewing during shocks and causing portions of the cup 10 from being pulled away from the product during such shocks, thereby reducing the likelihood of product-cup separation.

Figure 8:
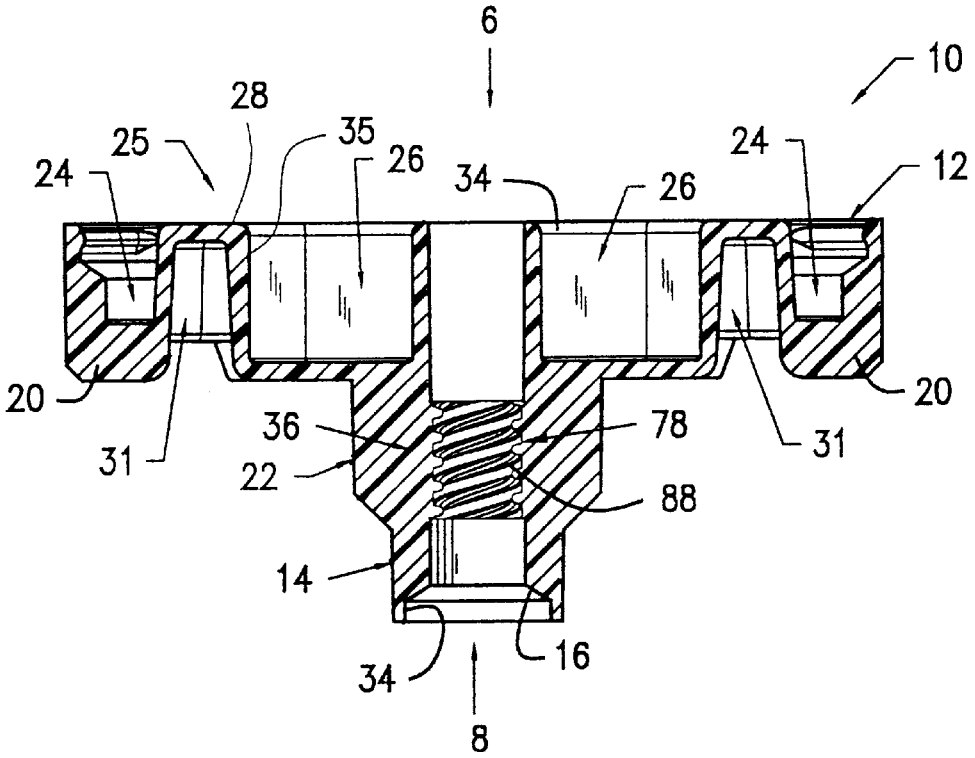
FIG. 8 is a partial longitudinal cross sectional view of the elevator cup taken along 8—8 of FIG. 7.
Figure 7:
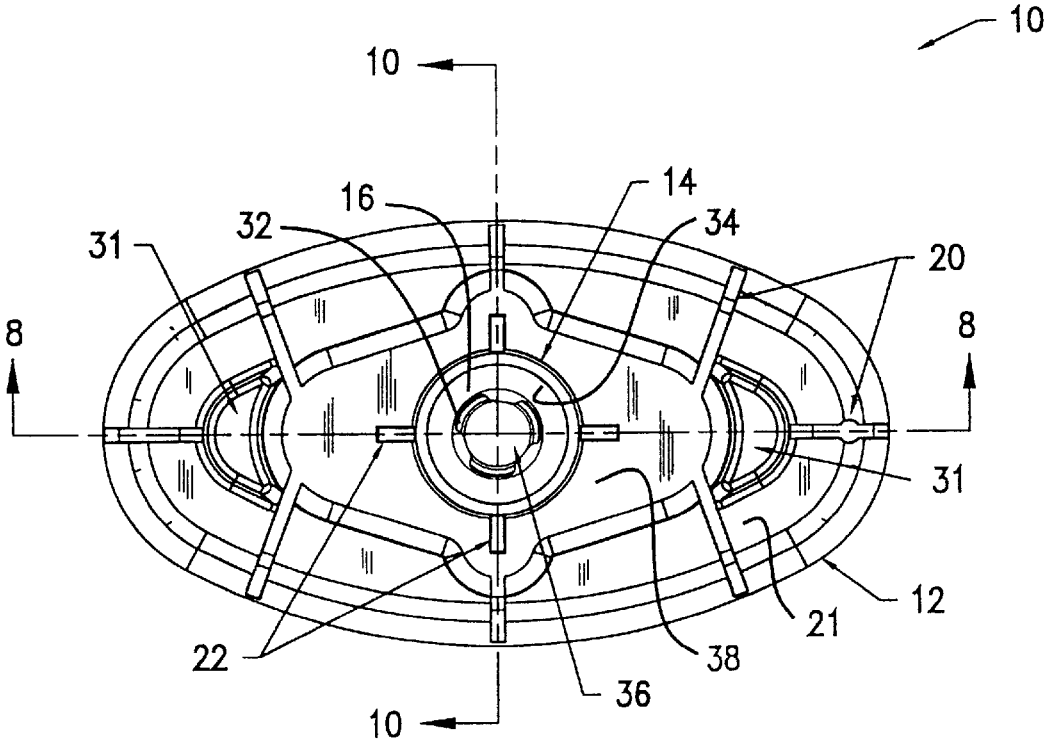
FIG. 7 is a bottom plan view of the elevator cup.
Figure 9:
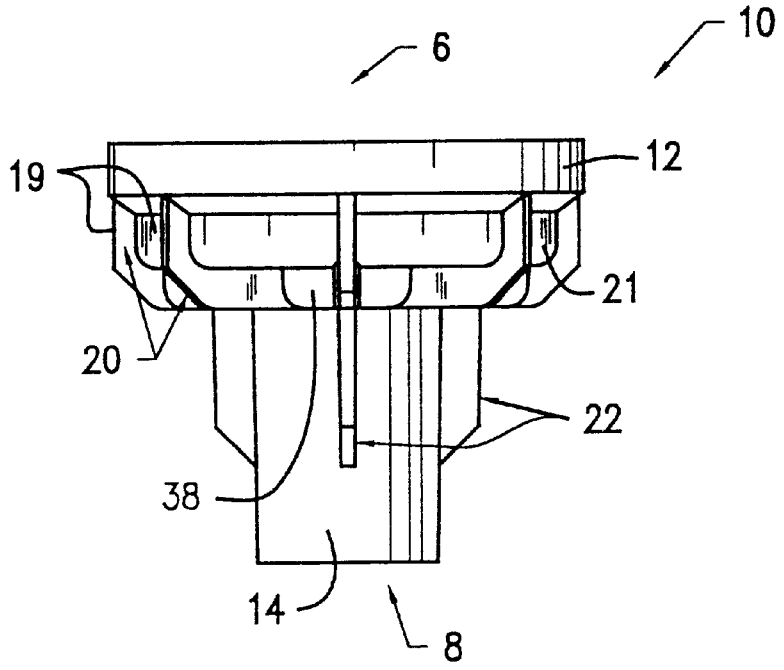
FIG. 9 is a right side elevational view of the elevator cup.

As best seen in FIGS. 4, 7, and 8, the partition 28 further includes a cavity 31 open at the bottom portion 6 and defined by the inside and outside sidewalls 33 and 35 at the end portions 25 thereof. This provides additional weight reduction to the cup 10 without compromising strength.

Figure 10:
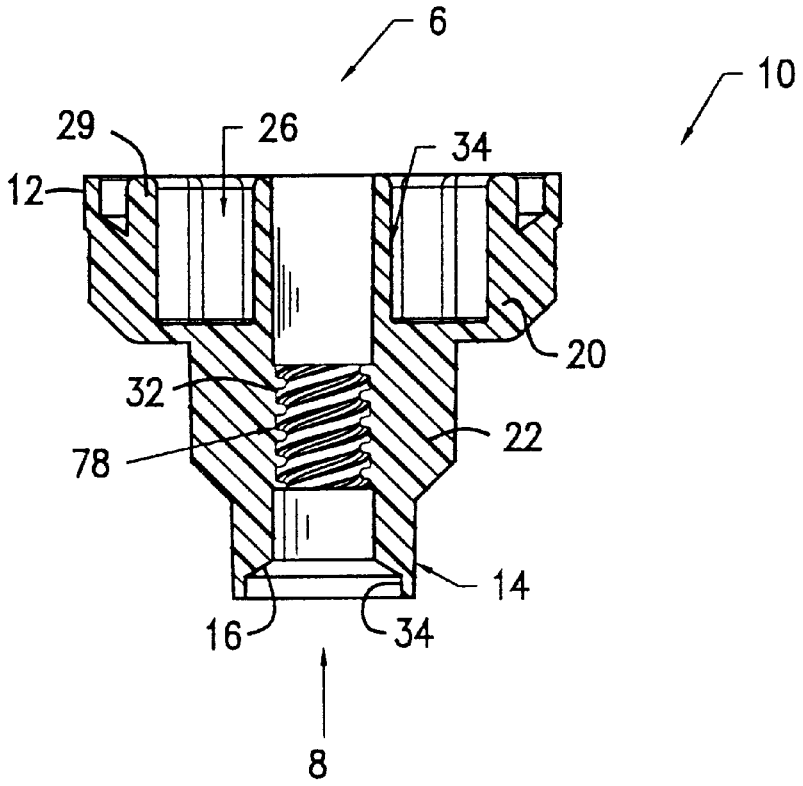
FIG. 10 is a partial cross sectional view of the elevator cup taken along 10—10 of FIG. 7.

FIGS. 8 and 10 show cross sectional views of cup 10. FIG. 8 is taken along the major axis of cup 10, and FIG. 10 along the minor axis.

Figure 11:
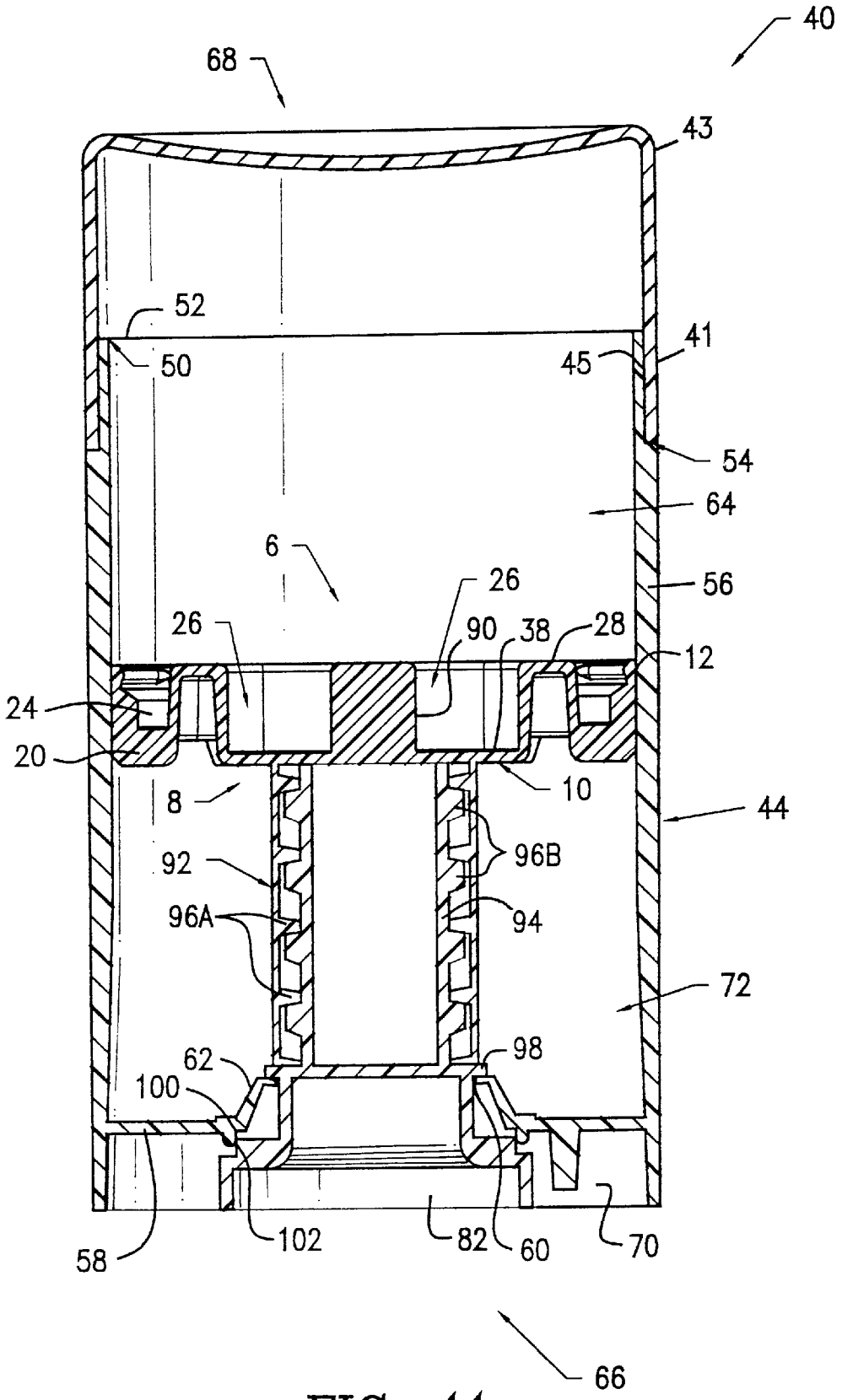
FIG. 11 is a cross sectional view showing an alternative form of the screw-type stick-form product container with an elevator cup of an alternative embodiment of the invention disposed therein.

Various configurations of cup moving mechanisms are available for advancing or retracting material being dispensed from a container, whereby the cup 10 may be modified to adapt to the variety of such mechanisms without deviating from the principle of the present invention. Referring to FIG. 11, an alternative representative embodiment of the package 40 for dispensing the stick-form product including an alternative embodiment of the cup 10 is shown. The moving mechanism of package 40 is different from the one utilized in the previous embodiment. The cup 10 is essentially the same as the embodiment previously described with certain modifications.

In this particular embodiment, the cup 10 possesses an imperforate construction that segregates the lower chamber 72 from the upper product chamber 64 forming a better barrier against leakage of product volatiles during the filling process and during consumer usage. In the previous embodiment, the threaded shaft member 78 of the spindle 76 projects through and is in threaded engagement with a threaded central hub 36 of the cup 10. The projection into the product causes an appearance problem with the product. In this connection, after the stick-form product has been partially used a central hole (or, if the material is soft, an unattractive depression) appears in the applicating surface. Such packages which often contain products with volatile components provide problems in sealing against leakage between the spindle 76 and the cup 10. In the present embodiment, both considerations are taken onto account.

In FIG. 11, the cup 10 includes a solid vertically projecting stud 90 disposed at the center of the top portion 6. An cylindrical sleeve 92 having internal threads 96A, vertically extends from the base 38 of the cup 10. Disposed within the barrel 44 and in threaded engagement with the sleeve 92, is a drive column 94 with threads 96B and dial wheel 82. The column 94 axially extends from the aperture 60 within barrel 44, whereas the dial wheel 82 is external of the barrel 44 and partially disposed within a stepped recessed area 70 formed between the sidewalls 56 at the lower end 66. The column 94 is provided with a retaining collar 98 that is in snap fit engagement with tapered tabs 62 of the base wall 58. A stepped bore 100 formed from the base wall 58 engages with a stepped shoulder 102 to keep the column 94 securely retained within the barrel 44 while permitting rotational movement. During assembly, the upper portion of the column 94 is pushed through the aperture 60, the retaining collar 98 is snapped through the tabs 62, thereby captively retaining the lower part of the collar 98 against the top edge of the tabs 62 and the stepped shoulder 102 of the dial wheel 82 against the stepped bore 100 of the base wall 58, as shown.

Figure 12:
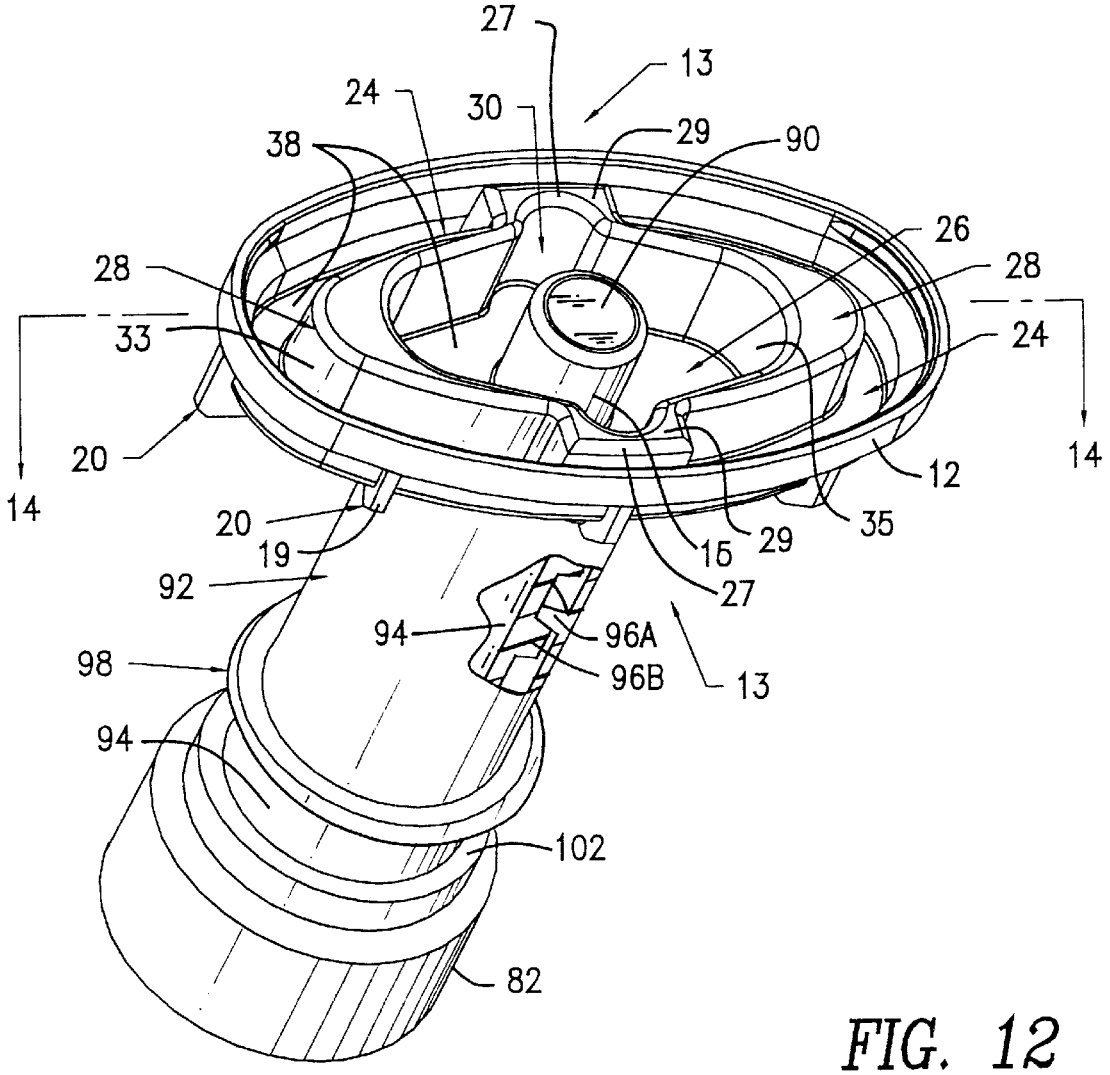
FIG. 12 is a top perspective view, partly broken away, of the alternative embodiment of the elevator cup of FIG. 11 with a tubular threaded cylindrical sleeve of the elevator cup threadedly engaged to a threaded drive column therein.
Figure 13:
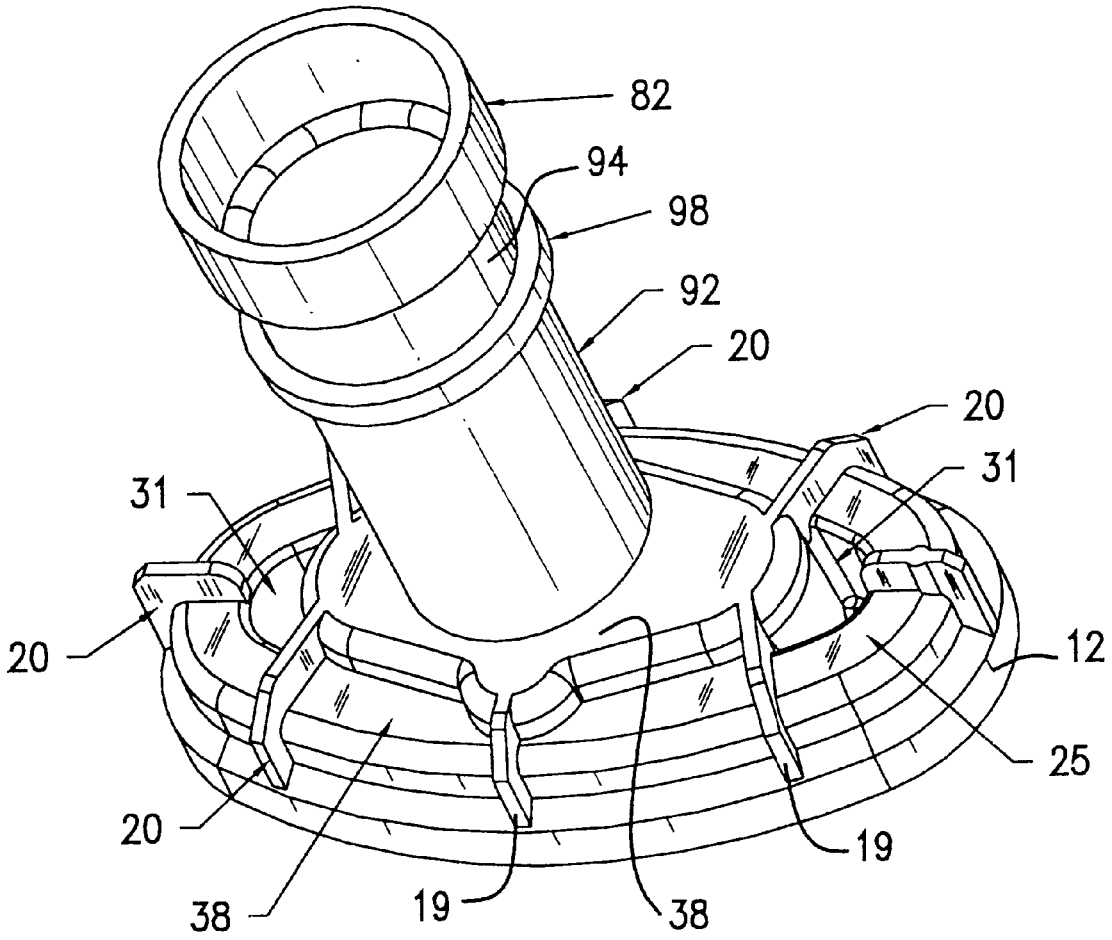
FIG. 13 is a bottom perspective view of the alternative embodiment of the elevator cup/drive column assembly as shown in FIG. 12.

Referring specifically to FIGS. 11, 12 and 13, the cup 10 is shown with the column 94 threadedly retracted into the sleeve 92. The sleeve 92 and column 94, together, forms a telescopically extending mechanism for advancing and retracting the cup 10 along the internal surface 46 of the barrel 44. By rotating the dial wheel 82 of the column 94 in the clockwise or counterclockwise direction, the sleeve 92 is extended or retracted telescopically, respectively, which in turn, pushes or pulls, respectively, the cup 10 up or down depending on the orientation of the threads along the column 94 within the barrel 44. As the sleeve 92 travels up or down the column 94, the cup 10 and the product is advanced or retracted, respectively, through the outlet 50.

Figure 14:
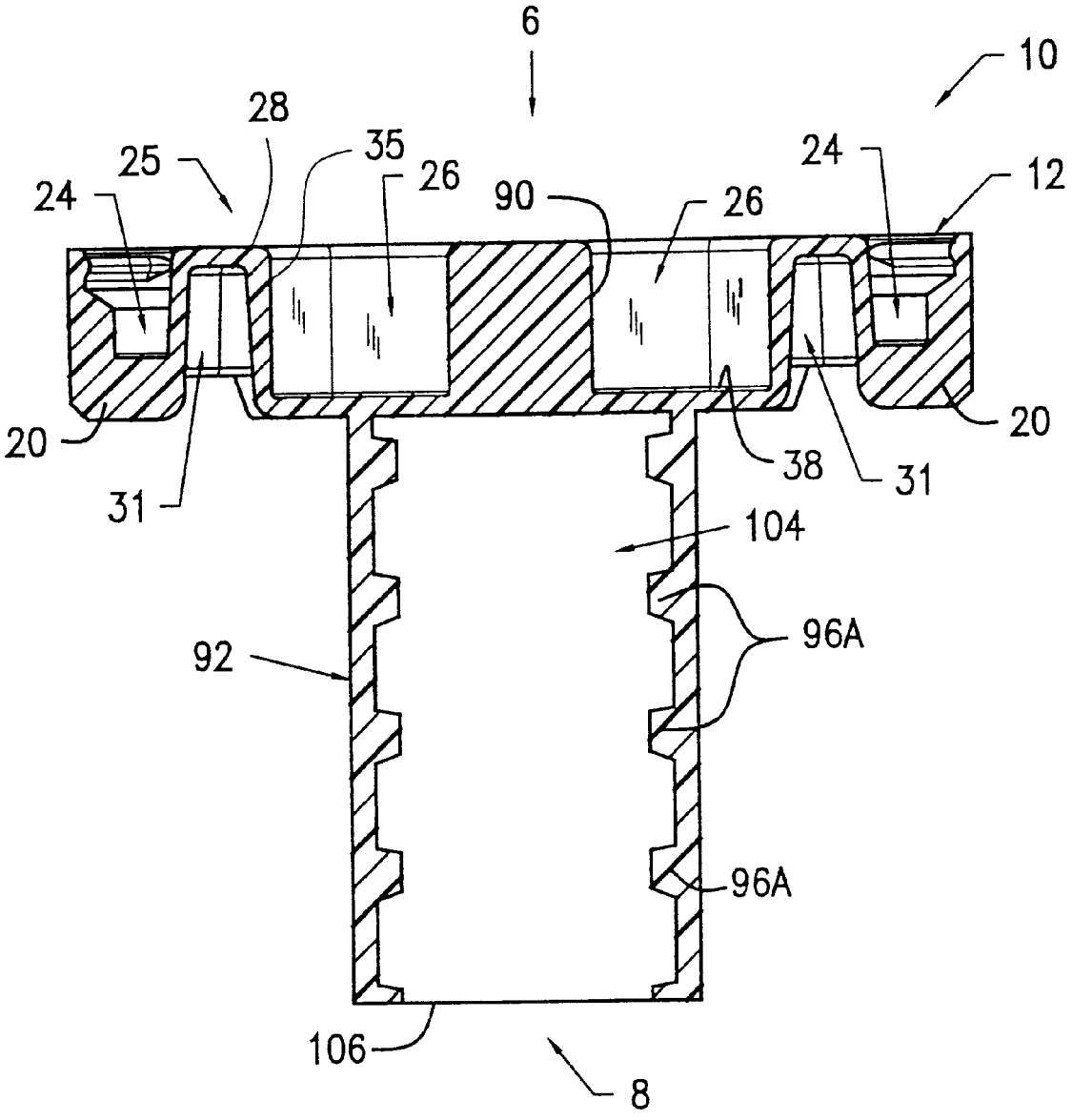
FIG. 14 is a longitudinal cross sectional view of the alternative embodiment of the elevator cup taken along 14—14 of FIG. 12.

In FIG. 14, a cross sectional view of the cup 10 is shown without the column 94 threadedly engaged thereto. The stud 90 is disposed in the center of base 38 to provide contact surface area for the product and reduce product hang up mass. The remainder of the surface features at the top end 6 of the cup 10 is the same as described in the previous embodiment. The sleeve 92 includes a cavity 104 and an opening 106 at the bottom end 8. The column 94 reversibly occupies the cavity 104 through opening 106. The cup 10 is in its lowermost position when the column 94 fully occupies the cavity 104 as the dial wheel 82 is turned. The cup 10 is at the maximum height when the column 94 is substantially extracted from the cavity 104 by turning the dial wheel 82 in the opposite direction. In addition to providing an moving means, the sleeve 92 provides rigid support for the cup 10 to limit lateral bending and flexing and keeps the cup 10 horizontally oriented in the barrel 44. By limiting such flexing and shifting of the cup 10, the likelihood the product separates from the cup 10 is substantially minimized.

Figure 15:
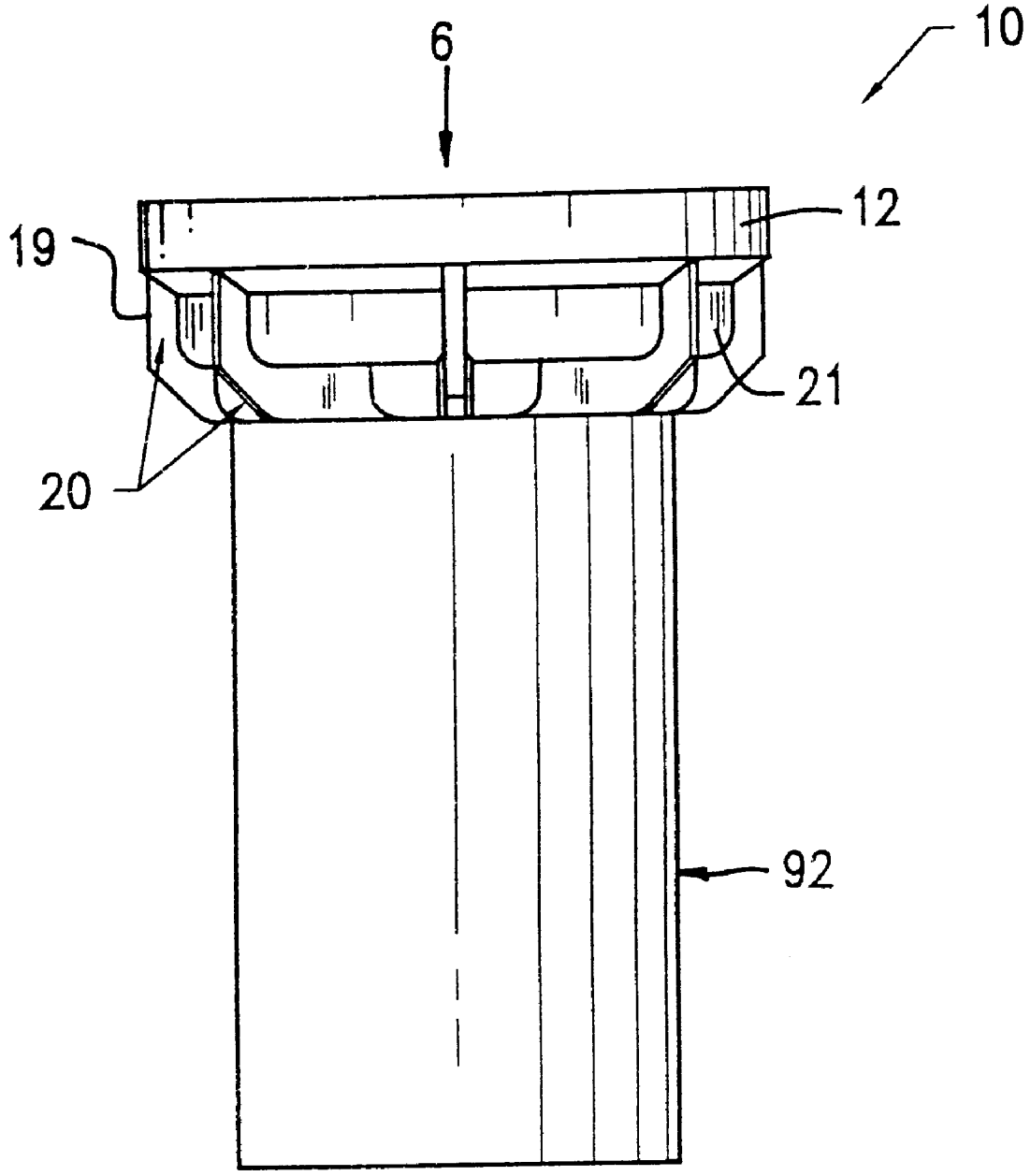
FIG. 15 is a side elevational view of the elevator cup of FIG. 11.
Figure 16:
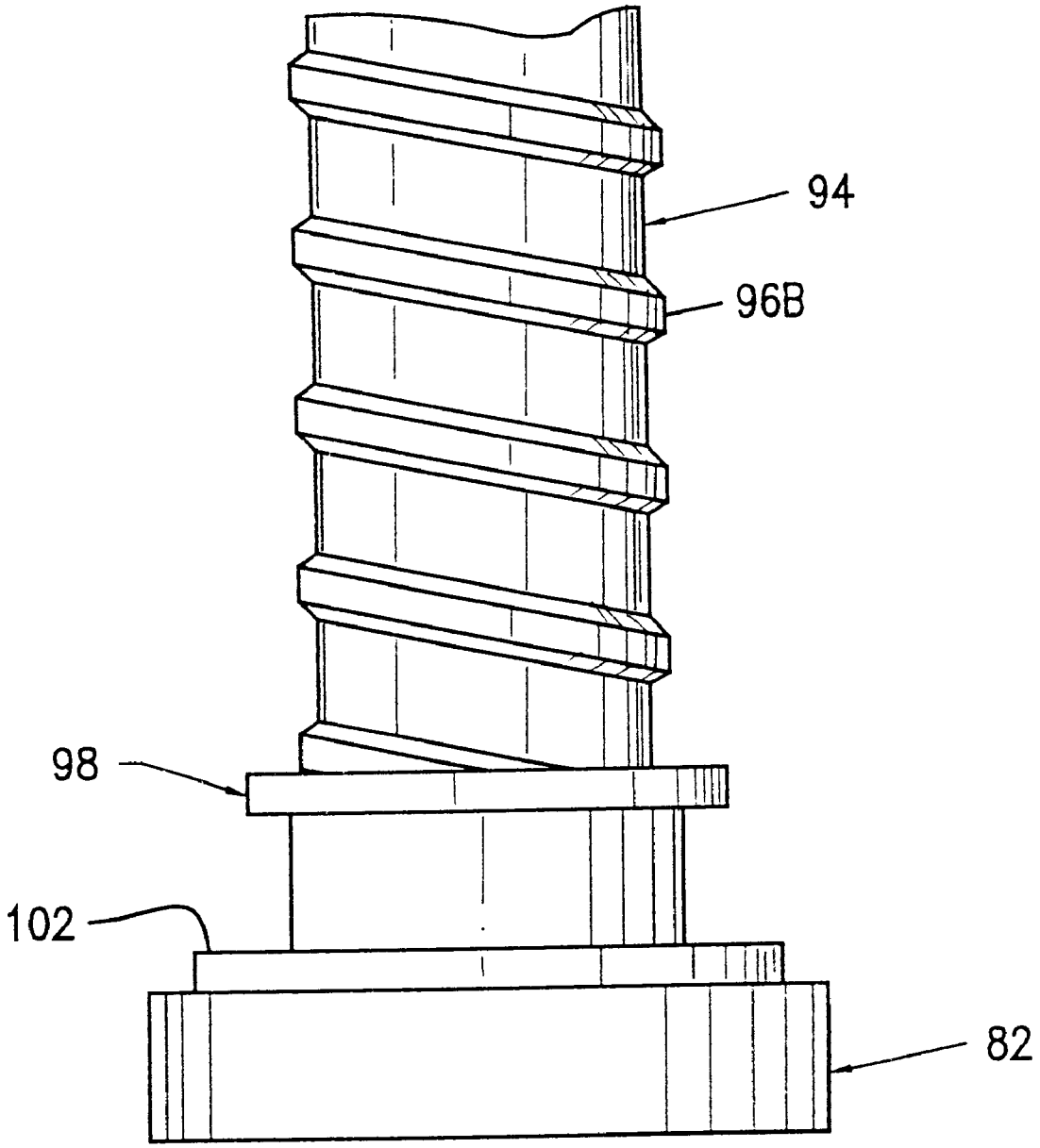
FIG. 16 is an elevational view of the threaded spindle of FIG. 11.

FIG. 15 illustrates an elevational side view of the cup 10. FIG. 16 shows an elevational view of the threaded column 94.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A dispensing system including a container for holding and selectively dispensing a portion of a solid stick-form product, an innermost end portion of said product residing within an elevator cup, said dispeening container having an internal surface, an open top end, a closed bottom end, said closed bottom end captively retaining means for selectively reciprocally moving said elevator cup in a piston-like manner between a retracted position adjacent said closed bottom end and a fully advanced position adjacent the open top end, wherein the improvement comprises said elevator cup including means having a high adhesive retention of said product, said elevator cup further including:

a horizontal base having top and bottom portions, said top portion of said base being configured for retaining a portion of said product;

said horizontal base being configured for engagement with said moving means;

a ductile flange extending along the perimeter of said base for sealing against said internal surface of said container to prevent seepage of liquid product and product volatiles, and to absorb and distribute shock associated with handling of said container, away from said product; and an oblong continuous and closed inner partition having an outside sidewall and an inside sidewall, disposed on said top portion of said elevator cup, for forming two opposing peripheral basins between said flange and said outside sidewalls of said inner partition, and a central basin bounded by the inside side wall of said inner partition.

2. The dispensing system of claim 1, wherein said elevator cup further includes a plurality of radially directed stabilizing ribs being arranged in a spaced apart manner on said bottom portion of said cup along the periphery of said base, extending from said ductile flange to an inner region of the bottom portion of said cup.

3. The dispensing system of claim 1, wherein the inside sidewall of said inner partition of said elevator cup further includes a pair of opposed semicircular channels disposed therein.

4. The dispensing system of claim 1, wherein said moving means includes a spindle, said closed bottom end includes a center aperture therein, and said spindle includes a dial wheel having a threaded shaft axially oriented within said container and rotatably mounted at said closed bottom end through said center aperture.

5. The dispensing system of claim 4, wherein said elevator cup further includes:

a continuous hollow threaded center post projecting vertically through the center of said base;

said center post being configured for threaded engagement with said threaded shaft of said spindle; and means for sealing said center post against said spindle to prevent seepage of liquid product and product volatiles from said elevator cup.

6. The dispensing system of claim 5, wherein said elevator cup further includes a plurality of gusset plates being arranged in a spaced apart manner radially around said center post on said bottom portion of said elevator cup.

7. The dispensing system of claim 5, wherein said sealing means includes:

a tapered annular ring about the lower end of the spindle; and a circular chamfered ring-like surface within a recess in the bottom of said elevator cup, being configured for sealing engagement with said tapered annular ring.

8. The dispensing system of claim 1, wherein said moving means includes a dial wheel, said closed bottom end includes a center aperture therein, said dial wheel being rotatably mounted at the closed bottom end, and having an externally threaded column extending axially therefrom through said center aperture into said container and in threaded engagement with an internally threaded cylindrical sleeve extending from a closed bottom portion of the base of said elevator cup, so that rotation of said dial wheel relative to said container and elevator cup provides reciprocally axial movement of said elevator cup.

9. The dispensing system of claim 8, wherein said elevator cup further includes a vertically projecting stud centrally disposed on said top portion thereof, for increasing adhesive contact area with said retained portion of said product.

10. An elevator cup for a stick-form product dispenser, comprising:

a horizontal base having top and bottom portions, said top portion being configured for retaining an end portion of a solid stick-form product; and a ductile flange extending along the perimeter of said base; and an oblong continuous and closed inner partition having an outside side wall and an inside side wall disposed on said top portion of said elevator cup for forming two opposing peripheral basins between said flange said outside side wall of said inner partition, and a central basin bounded by the inside side wall of said inner partition.

11. The elevator cup of claim 10, further including a plurality of radially directed stabilizing ribs being arranged in a spaced apart manner on said bottom portion of said elevator cup along the periphery of said base, extending from said ductile flange.

12. The elevator cup of claim 10, further including:

a continuous hollow threaded center post projecting vertically through the center of said base; and said center post being configured for threaded engagement with a threaded spindle of means for selectively reciprocally moving said elevator cup within a container for dispensing a stick-form product in one mode of operation, and for retracting said product within said container in another mode of operation.

13. The elevator cup of claim 10, further including:

a vertically projecting stud centrally disposed within said central basin on the top portion of said base;

a hollow threaded cylindrical member projecting away from bottom portion of said elevator cup, having a first and second ends;

said first end being rigidly fixed to said bottom portion of said elevator cup and said second end having an opening; and said cylindrical member being configured for threaded engagement through said opening, with a threaded drive column of a telescoping means for selectively reciprocally moving said elevator cup within a container for dispensing a stick-form product in one mode of operation, and for retracting said product within said container in another mode of operation.

14. The elevator cup of claim 10, wherein said inner partition being configured to include a pair of opposed semicircular channels in said central basin.

15. The elevator cup of claim 10, further including a plurality of gusset plates being arranged in a spaced apart manner radially around said center post on the bottom portion of said elevator cup.

16. The elevator cup of claim 10, is made of a plastic polymer composite.

17. The elevator cup of claim 16, wherein said plastic polymer composite is polyethylene.

* * * * *